US007987915B1

(12) United States Patent
Wiggins et al.

(10) Patent No.: US 7,987,915 B1
(45) Date of Patent: Aug. 2, 2011

(54) CIRCULATING SUB WITH MUDSAVER FOR DISPENSING AND CIRCULATING FLUID IN A WELL BORE

(75) Inventors: Richard Jay Wiggins, Runaway Bay, TX (US); Truman Randall Davis, Abilene, TX (US)

(73) Assignee: Express Energy Services Operating, LP, Bridgeport, TX (US)

( * ) Notice: Subject to any disclaimer, the term of this patent is extended or adjusted under 35 U.S.C. 154(b) by 263 days.

(21) Appl. No.: 12/356,003

(22) Filed: Jan. 19, 2009

(51) Int. Cl.
*E21B 33/12* (2006.01)
*E21B 21/00* (2006.01)
*F16K 43/00* (2006.01)

(52) U.S. Cl. ..... 166/386; 166/387; 175/218; 137/327

(58) Field of Classification Search ..... 166/319, 166/386, 387; 175/218, 317, 24, 38, 94, 175/99; 137/327
See application file for complete search history.

(56) References Cited

U.S. PATENT DOCUMENTS 5,392,862 A 2/1995 Swearingen
7,048,079 B1 5/2006 Parker
2002/0174988 A1* 11/2002 Szarka ..... 166/325

* cited by examiner

*Primary Examiner* — Kenneth Thompson
*Assistant Examiner* — James G Sayre
(74) *Attorney, Agent, or Firm* — Buskop Law Group, PC; Wendy Buskop

(57) ABSTRACT

A circulator sub tool and fluid saver with a system and method for dispensing and circulating fluid in a well bore having a threaded packer sub with a quick coupler body, and wherein diameters for each annulus of the quick coupler body and the sub body are substantially identical enhancing laminar flow through the threaded packer sub.

20 Claims, 7 Drawing Sheets

CIRCULATING SUB WITH MUDSAVER FOR DISPENSING AND CIRCULATING FLUID IN A WELL BORE

FIELD

The present embodiments relate generally to a system and method using a mudsaver and a circulating sub for drilling and completing subterranean wells, and more specifically to the filling and circulating of the drilling fluids in a casing string. The embodiments further relate to various methods and systems used in well bores and particularly, but not exclusively, to methods that relate to the operation of circulating subs used during downhole drilling operations using mudsavers.

BACKGROUND

A need exists for a method for circulating and dispensing fluid in a well bore that is a efficient, easy to maintain and reliable and enables quick connection with to other down hole tools while secured to a mudsaver. U.S. Pat. No. 7,048,079 depicts a typical mudsaver and is incorporated by reference herein.

It is known in the art to utilize the pressure of fluid pumped through a work string in a well bore to control a hydraulically activated tool in the well bore.

The hydraulic pressure to operate these tools is typically supplied from the surface of the well bore by pumps. Due to the distances of travel to the location, the pressure of these fluids and the tools operated using that pressurized hydraulic fluid can be difficult to control to provide a constant pressure and give a uniform control.

It has been recognized that methods to control the flow of hydraulic fluid adjacent a hydraulically operated downhole tool are advantageous, see U.S. Pat. No. 5,392,862, which is incorporated by reference herein. This patent describes a drilling mud flow control method of operating that provides the necessary fluid flow and pressure to activate an expanding remedial tool such as an under reamer, section mill or other cutting tool. A circulating sub is used with a drop ball seat to control pressure. The method prevents hydraulic fluid flow with the drop ball.

The method disposed in the issued patent has reliability problems. A need has exists for a method that is reliable, easy to use, and enables and operator to easily maintain its equipment.

It is a yet further an object of at least one embodiment of the present invention to provide method that allows selective control of fluid circulation when the tool is run in or tripped from the well.

It is a still further an object of the present invention to provide a method of accurately and reliably controlling hydraulic pressure to a hydraulically operated down hole tool in a well bore.

It is still further an object of the present invention to provide a system that includes a mudsaver and a circulating sub for accurately controlling fluids through a well bore.

The present embodiments meet these needs.

BRIEF DESCRIPTION OF THE DRAWINGS

The detailed description will be better understood in conjunction with the accompanying drawings as follows.

Figure 1:
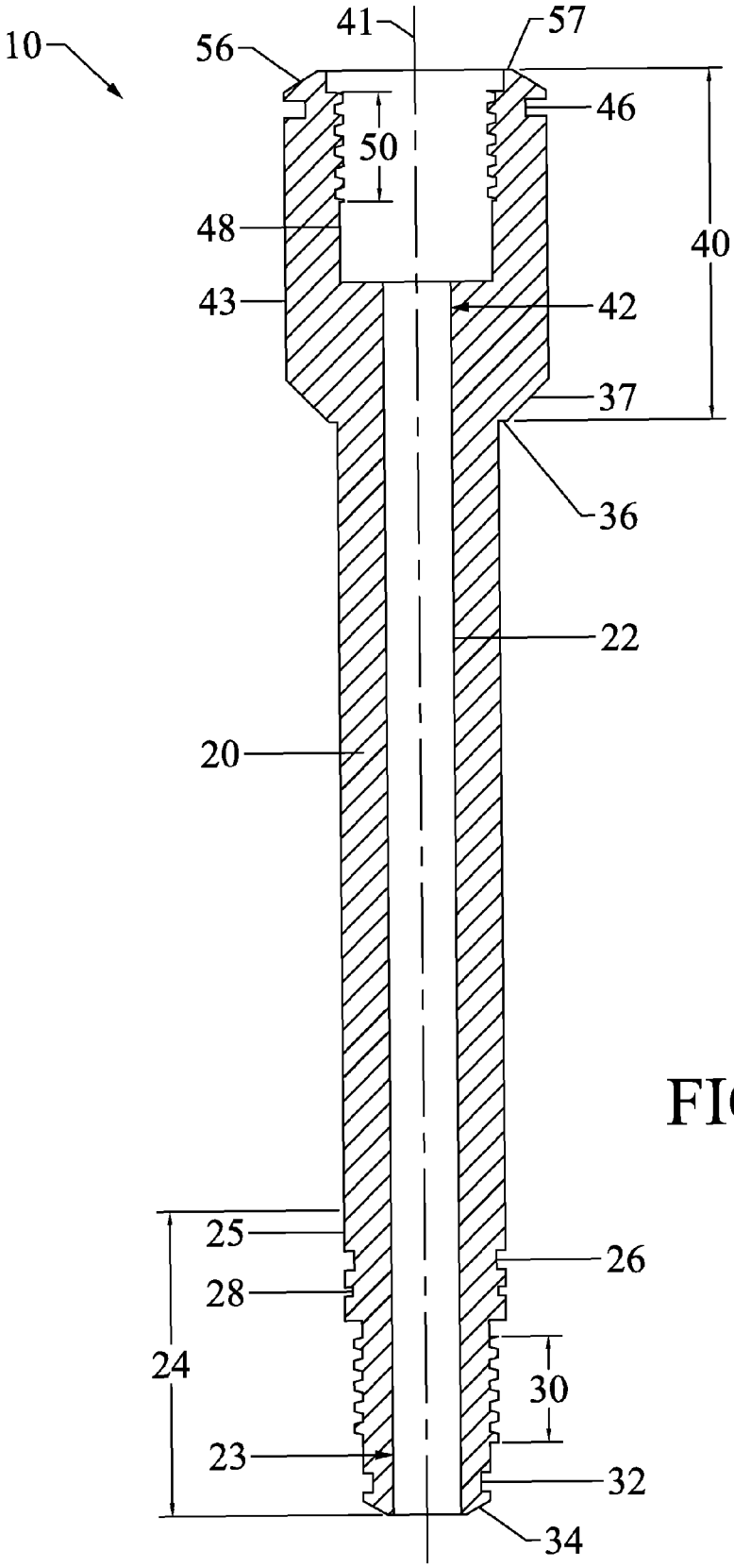
FIG. 1 illustrates a cross sectional side view of the packer sub in accordance with certain embodiments of the present invention that enabling the flow directions to be determined.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a system and method for dispensing and circulating fluid in a well bore. The system and method can use a circulator sub tool that principally contains a threaded packer sub coupled with a quick coupler body and can engage a fluid saver or mudsaver.

The embodiments further relate to a system and method for use in well bores and particularly, but not exclusively, to methods that involve circulating subs used during downhole drilling operations.

A benefit of the invention is that the two part assembly is quick easy and reliable to operate. With the pin embodiment of the invention, secondary seals are created for a more secure sealing environment for the tool, preventing fluid from flowing to the environment and polluting the surrounding soil. The redundant seal provides increased for an operator or user, as well as the sealing of the well bore fluids from the rest of the drill string.

The system and method contemplates circulating and controlling fluids in a well bore by first fluidly connecting a fluid saver, such as a mudsaver to a quick coupler sub. Next, a packer sub body can be threadably connected to the quick coupler sub. The packer sub body has a packer cup. The assembly now forms a circulator sub assembly with a fluid saver.

As a next step, the circulator sub assembly with fluid saver can be lowered into an oil field tubular in a well bore. Then, the oil field tubular is allowed to fill with fluid from a drilling fluid vessel, such as a drilling mud.

The next step can occur simultaneously, that is, the packer cup can be aligned with the annulus of the oil field tubular while the quick coupler can be aligned with the annulus of the oil field tubular.

The annulus of the oil field tubular is allowed to fill with fluid below the packer cup, the fluid coming from the drilling fluid vessel allowing fluid circulation to begin in the annulus.

When fluid circulation is discontinued, a compressed spring assembly is allowed to overcome circulating fluid pressures allowing the bullet seal or valve assembly to return to a closed position from an open position in the mud saver body preventing fluid loss and environmental contamination.

In an embodiment of the system and method, a threaded packer sub can have a sub body which can be integrally connected with an upper end to a lower end. In an embodiment, the sub body can have a lower end with a lower end annulus and an exterior.

The exterior can have a locking groove. The annulus can have a first inner seal, a threaded section, a second inner seal, and an inner threaded shoulder. The upper end can have an upper end axis along which is formed an upper end annulus. The upper end can also have a sub shoulder in communication with a centering guide face.

The exterior of the upper end can have an upper locking groove. On its interior, the upper end can also have an upper first inner seal area, an upper threaded section, and an upper locking retainer bore disposed through the upper end at an angle between about 60 degrees to about 90 degrees from the upper end axis. This retainer bore can be adapted for receiving an upper locking pin.

The system and method can contemplate in an embodiment using a quick coupler body for threadably engaging the sub body. This quick coupler body can have a quick coupler annulus, a quick coupler axis and a quick coupler exterior. A lower threaded adapter can be formed around the quick coupler annulus the quick coupler annulus can have two or more lower threaded retainer bores.

In an embodiment of the system and method, the quick coupler can have a first quick coupler face formed adjacent to the lower threaded adapter around the annulus. A quick coupler lower seal can be formed around the quick coupler annulus above the first quick coupler face and a second seal area can be formed around the quick coupler annulus.

An upper threaded area can be formed around the quick coupler annulus. A third seal area can be formed around the quick coupler annulus. A quick coupler locking groove can be formed in the quick coupler exterior. A quick coupler retainer bore can be disposed between about 60 degrees to about 90 degrees from the quick coupler axis adapted for receiving a quick coupler retainer pin.

A quick coupler guide face can be formed in the quick coupler exterior.

A quick coupler shoulder can be formed in the quick coupler exterior for use in an embodiment of the method. The diameters for each annulus of the quick coupler body and the sub body can be substantially identical to be usable in the method. The method can further contemplate that an enhanced laminar flow for fluid can be provided with this unique series of steps using the threaded packer sub.

In an embodiment of the system and method, the quick coupler can use a tapered outer body guide face, which can be formed in the quick coupler exterior between the quick coupler lower seal and a quick coupler lower face.

In another embodiment of the system and method, the quick coupler can have an inner threaded shoulder that can form a metal to metal seal with a metal to metal seal on the quick coupler body.

In still another embodiment of the system and method, locking grooves can be used to support seals that can be thermoplastic seals along the circulating sub. These seals can further be o-rings. The quick coupler body can be carbon steel.

In still other embodiments of the system and method, a gauge ring can be disposed over the sub body adjacent the quick coupler shoulder, or a packer cup can surround the sub body in proximity to the gauge ring for additional security. Similarly, a packer thimble can surround the sub body adjacent the packer cup.

The embodiments contemplate using a fluid saver, which can be a mudsaver, which can connect to the circulating sub of the invention. The fluid saver can have an outer housing that retains upper and lower valve pistons. The pistons can be disposed reciprocally within the housing to provide a check valve through which fluid, such as drilling mud, is permitted to flow in one direction under pump pressure.

Turning now to the Figures, FIG. 1 through FIG. 5 show a tool usable with embodiments of the method.

The threaded packer sub 10 can have a sub body 20, with a sub body annulus 22, a lower end 24, and an upper end 40. The lower end can have a lower end annulus 23 and an exterior 25. On the exterior of the lower end can be a locking groove 26. A first inner seal 28 and a second inner seal 32 can be formed on the exterior 25. A threaded section 30, between about 1 inch to about 3 inches can be located between the first and second inner seals. The inner seals represented here can be rubber O-rings.

An inner threaded shoulder 34 can also be in the lower end 24 at the outer most portion of the lower end. The inner threaded shoulder 34 and second inner seal 32 can be used for engaging the quick coupler.

The upper end 40 can have a sub shoulder 36 machined at about 90 degrees from an upper end axis 41. Adjacent the sub shoulder 36 can be a centering guide face 37 at an angle from about 30 degrees to about 60 degrees from the upper end axis 41.

The upper end can have an upper end annulus 42 and an upper end exterior 43 surrounding the upper end annulus.

The upper end further can have an upper locking groove 46 for receiving an o-ring or other sealing device.

The upper end can have an upper first inner seal area 48, an upper threaded section 50 adjacent the upper first inner seal area 48. The upper threaded section 50 can between about 1 inch to about 3 inches long and can have right or left handed thread types pending customer well bore specifications.

FIG. 1 also shows the upper guide face 56, which can be on the upper end exterior 43. The upper guide face can be at an angle between about 30 degrees to about 60 degrees from the upper end axis 41. An upper shoulder 57 can be at the end of the upper end 40 opposite the sub body 20.

Figure 2:
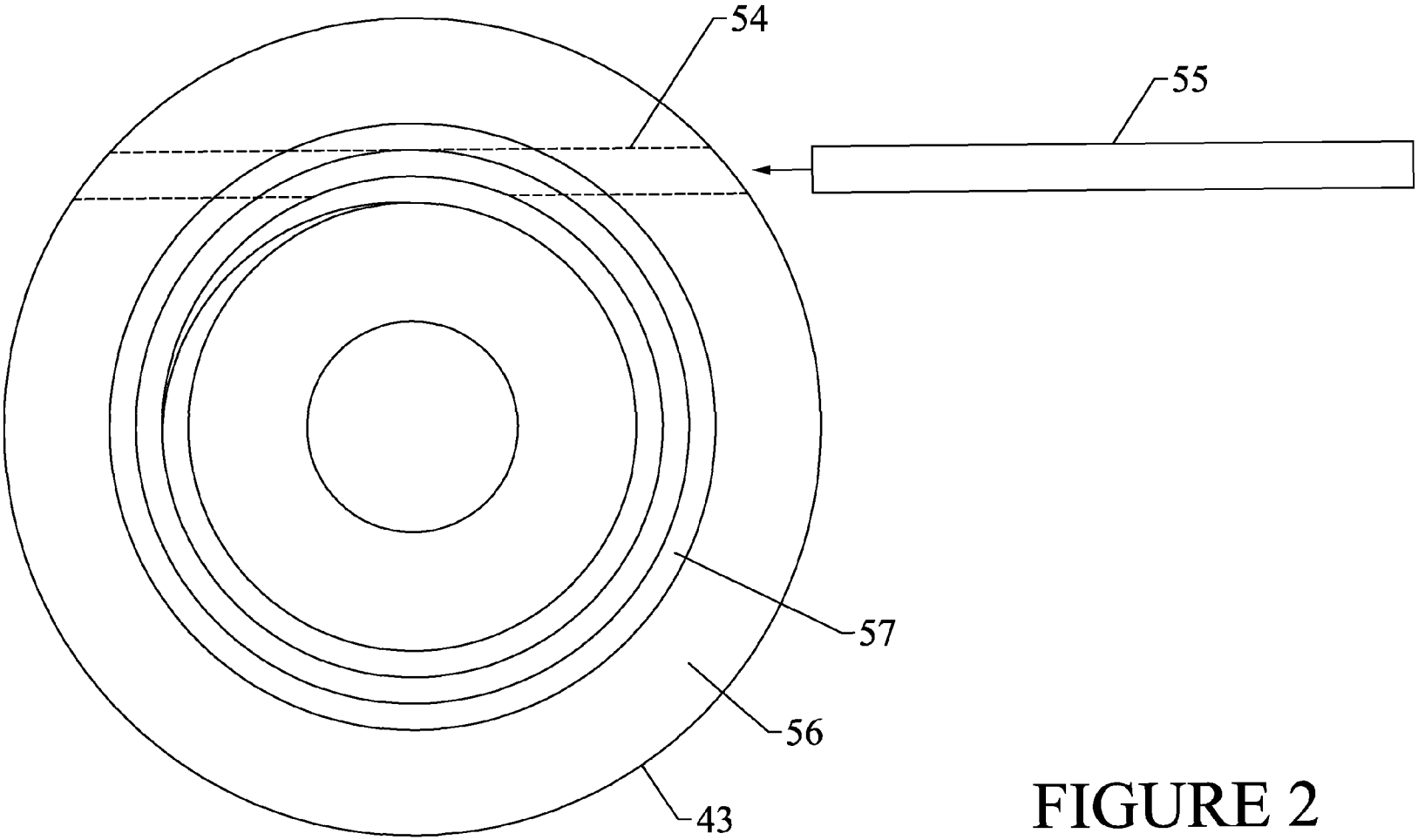
FIG. 2 illustrates a cross sectional top view of the packer sub for use in the methods of the invention.

FIG. 2 shows a top view of the upper end, depicting the upper end exterior 43 with an upper locking retainer bore 54 adapted for receiving an upper locking pin 55. The upper locking retainer bore can have a diameter between about 0.2 inches to about 0.5 inches and the upper locking pin can be made from solid steel, or can be a hollow pin.

Figure 3:
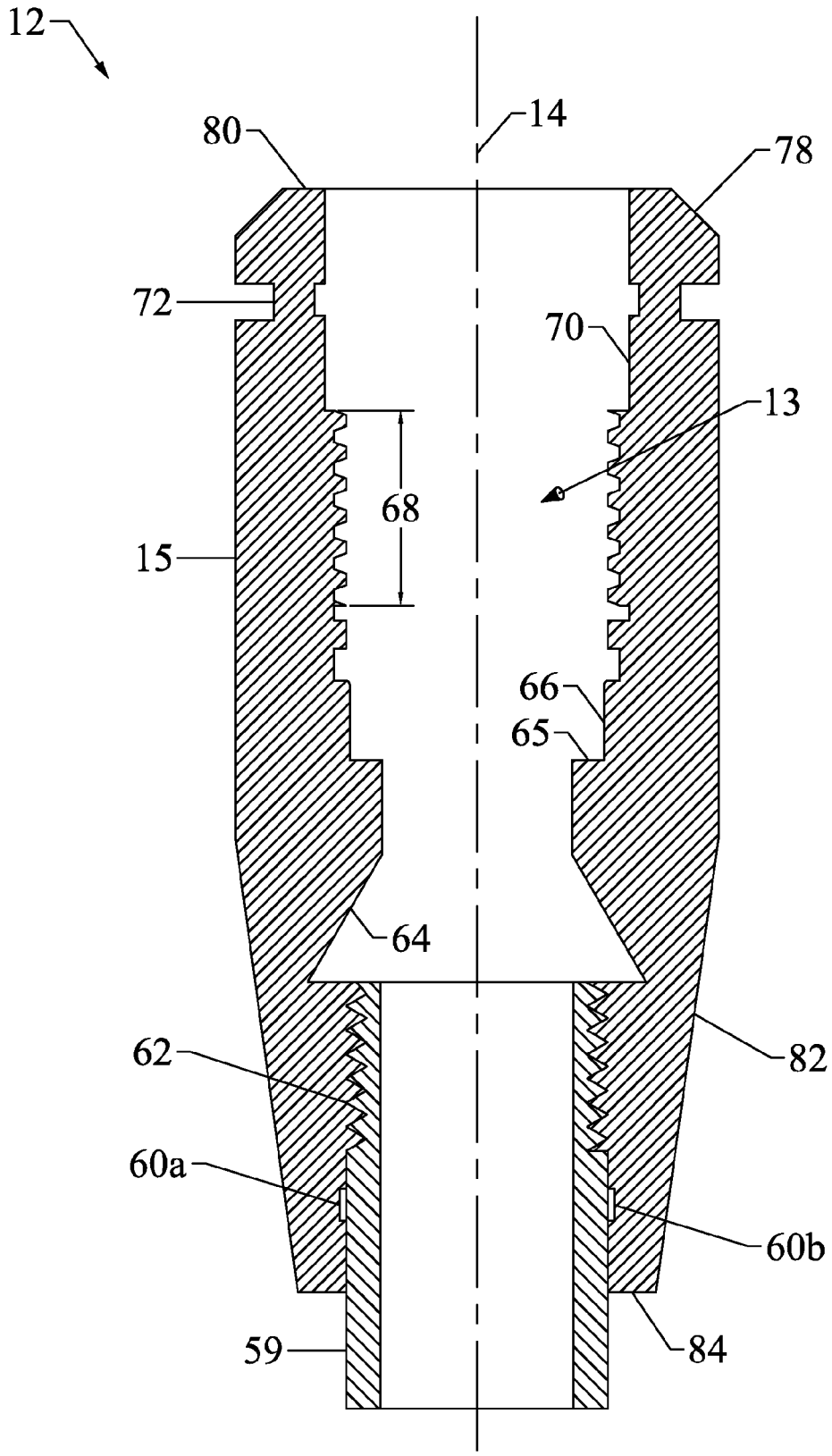
FIG. 3 illustrates a cross sectional side view of the quick coupler body for use in the methods of the invention.

FIG. 3 shows a quick coupler body 12 with a quick coupler annulus 13, a quick coupler axis 14 and a quick coupler exterior 15.

The quick coupler 12 can have a lower threaded adapter 62 for engaging hose assemblies, or extending or engaging other wellbore components needing fluid circulation. A wellbore assembly extension hose 59 can be connected to the lower threaded adapter 62. The lower threaded adapter 62 can have threaded retainer bores shown at 60*a* and 60*b*.

Figure 4:
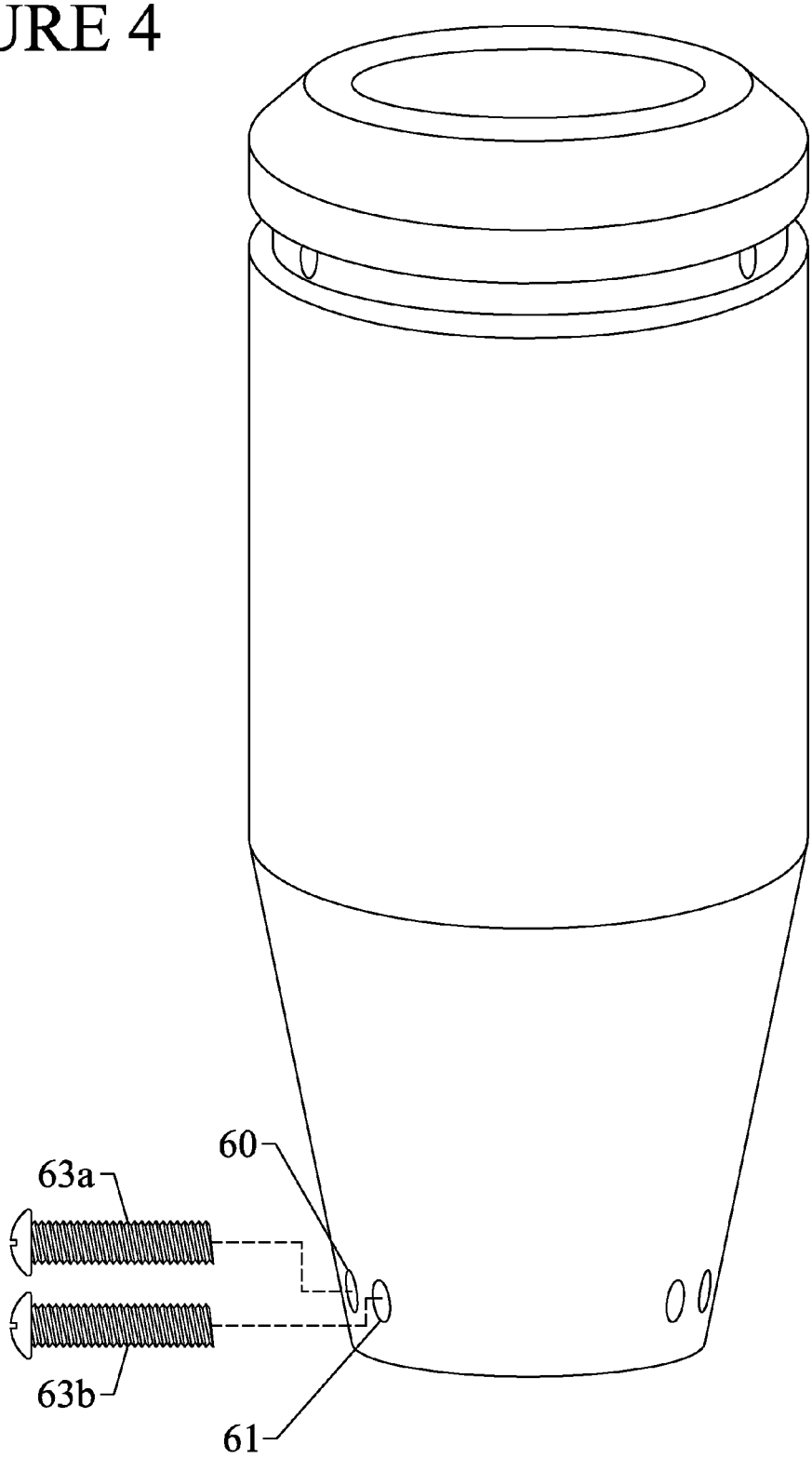
FIG. 4 illustrates a cross sectional top view of the quick coupler body for use with embodiments of the present invention.

FIG. 4 shows an isometric view of the quick coupler with at least two threaded retainer bores 60 and 61 for engaging locking screws 63*a* and 64*b*.

Returning to FIG. 3, the quick coupler can have a first quick coupler face 64 adjacent the lower threaded adapter 62. The first quick coupler face 64 can be at about a 60 degree angle from the quick coupler axis 14, but the face 64 can be at an angle from about 40 degrees to about 70 degrees.

A quick coupler lower seal 65 can be formed adjacent the first quick coupler face 64. This seal 65 can be a metal to metal seal.

A second seal area 66 can be adjacent the quick coupler lower seal 65. This second seal area 66 can seal with the second inner seal is shown in FIG. 1.

The upper threaded area 68 can have a length between about 1 inch to about 3 inches. The upper threaded area 68 can have left or right handed thread types pending well bore or customer requirements.

The quick coupler body 12 can also have a third sealing surface 70 on its interior. This third sealing surface 70 can be a polished sealing surface that accepts the seals of inner seal 28.

The exterior of the lower threaded adapter can have a quick coupler locking groove 72. The quick coupler locking groove 72 can be used for securing a seal such as a retainer o-ring of an interlocking composite material.

The quick coupler body 12 can have a quick coupler guide face 78, which can be adjacent to the quick coupler shoulder 80, both of which can be formed on the exterior of the quick coupler body 12. The quick coupler guide face 78 can have an angle between about 30 degrees to about 70 degrees from the quick coupler axis 14.

The quick coupler tapered outer body guide face 82 can be formed on the quick coupler exterior 15 and can provide a tapered exterior for the quick coupler body 12. The quick coupler lower face 84 can be the bottom-most surface of the quick coupler body 12 and is adjacent to the end of the tapered quick coupler outer body guide face 82.

Figure 5:
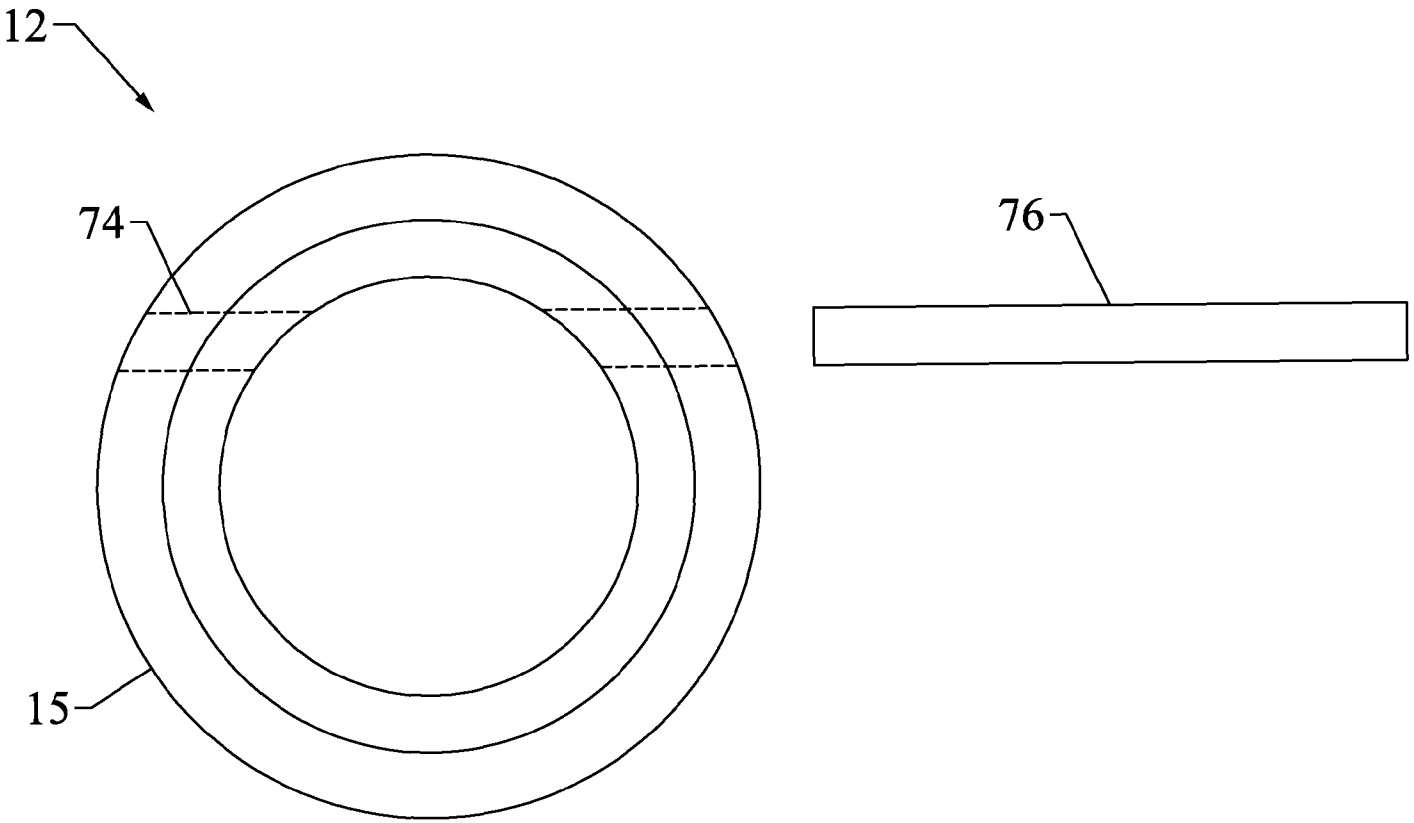
FIG. 5 depicts a fluid saver usable with the circulating sub of an embodiment of the invention.

FIG. 5 further illustrates a top view of the quick coupler body 12 having an exterior 15. A quick coupler retainer bore 74 can be seen in the quick coupler body 12 for retaining a quick coupler retaining pin 76, which is shown external to the quick coupler body. This retainer bore and pin can be identical to the sub body retainer bore and pin.

Figure 6:
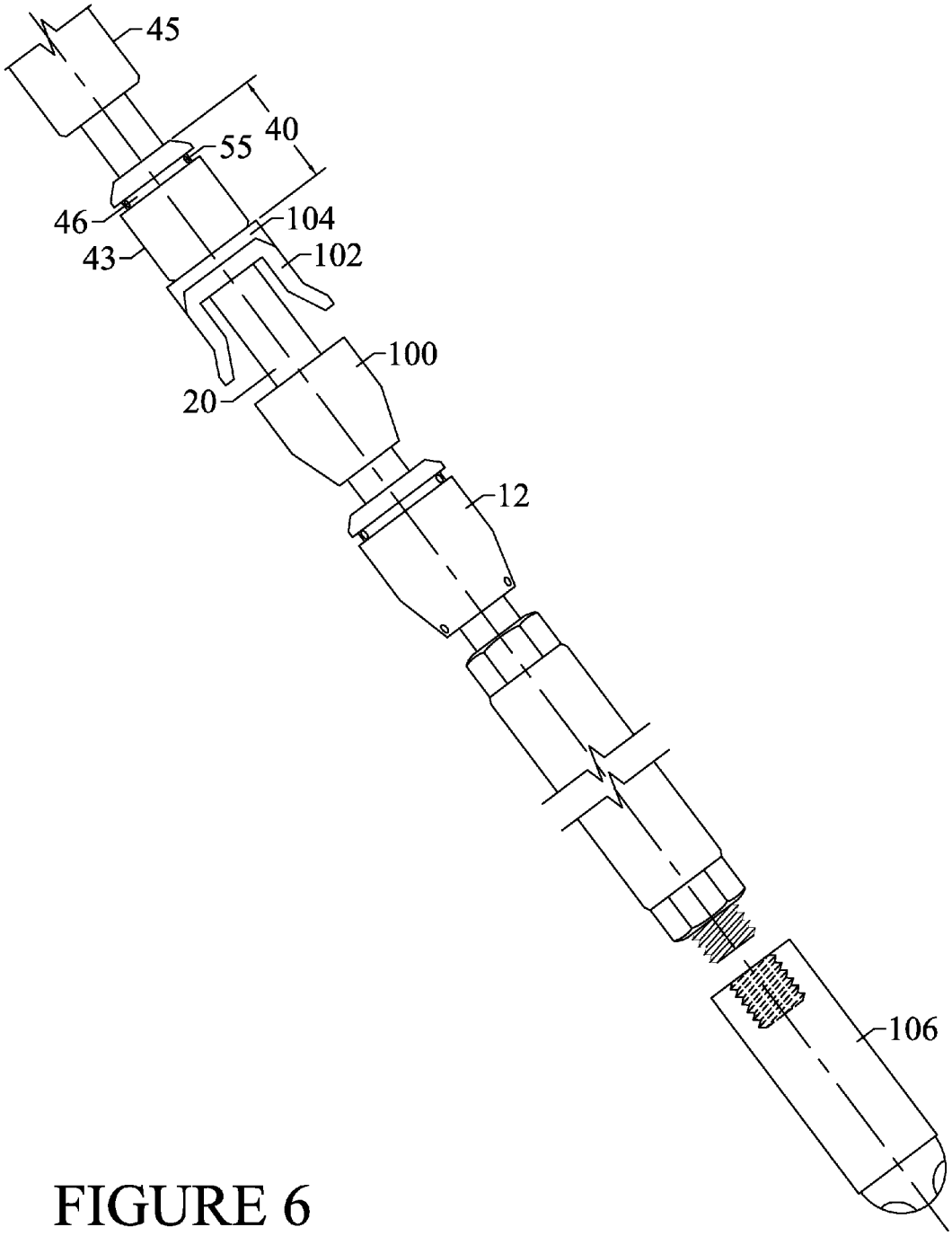
FIG. 6 illustrates the circulator sub assembly fully assembled.

FIG. 6 illustrates the circulator sub assembly fully assembled. The threaded packer sub 10 (shown in FIG. 1) can have a sub body 20, with an upper end 40. The circulator sub assembly can receive fluid from a drilling fluid vessel 45.

The upper end 40 can have an upper end annulus 42, shown in FIG. 1, and an upper end exterior 43 surrounding the upper end annulus.

The upper end exterior 43, on which can be formed an upper locking groove 46 for receiving an o-ring or other sealing device, can have an upper locking retainer bore 54 (shown in FIG. 2) disposed through the upper end at an angle between about 60 degrees to about 90 degrees from the upper end axis adapted for receiving an upper locking pin 55.

FIG. 6 also shows a thimble cup 104 and packer cup 102 surrounding the sub body 20.

A gauge ring 100 is shown disposed over the sub body 20 adjacent the quick coupler shoulder 80 (shown in FIG. 3) of the quick coupler body 12.

A fluid saver 106 is shown connected to the quick coupler body 12 via a metal sub. It is contemplated that the fluid saver 106 can be attached to the quick coupler body via a well bore assembly extension hose.

Figure 7:
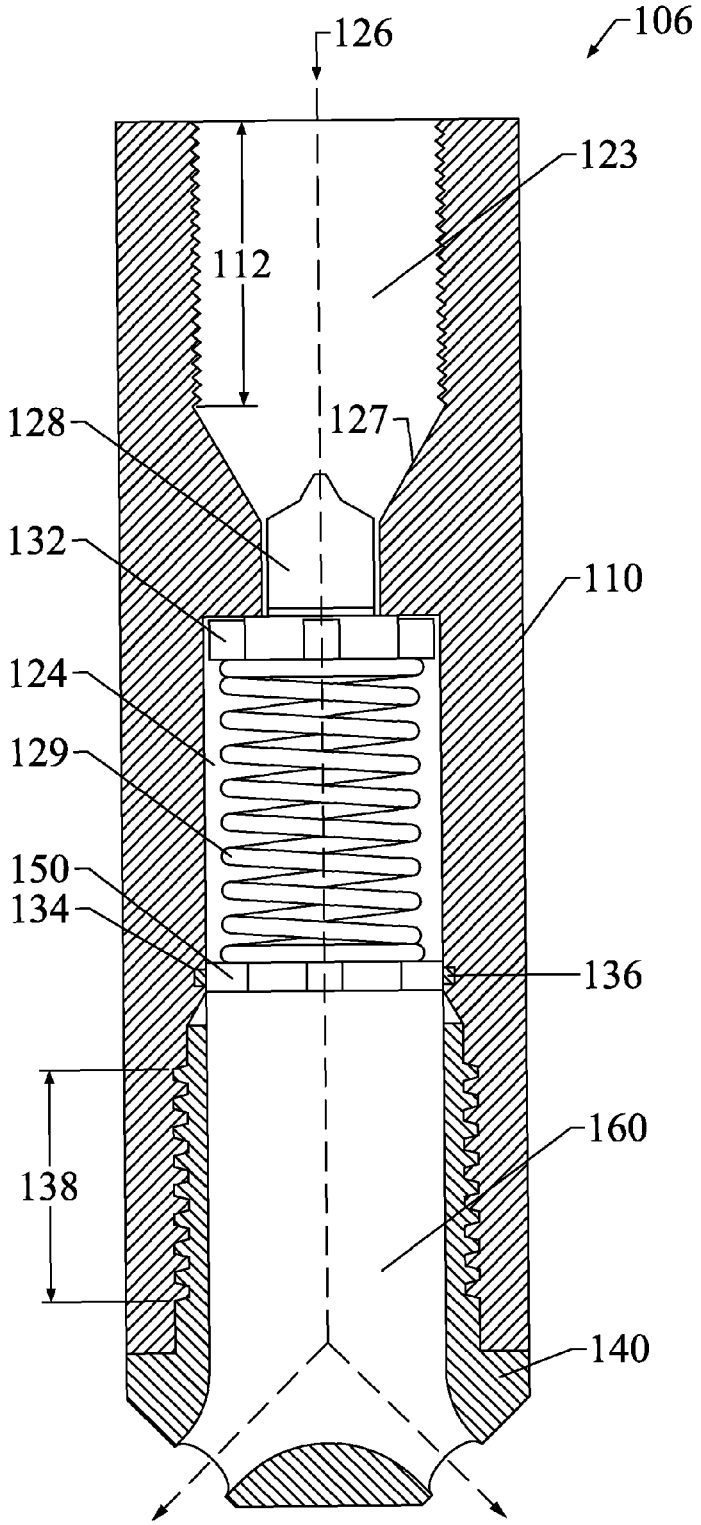
FIG. 7 shows a cross sectional view of the fluid saver.

FIG. 7 shows a cross sectional view of the fluid saver 106. Fluid saver 106 can have a fluid saver body 110 with an upper body threaded section 112.

The fluid saver body 110 can have a fluid saver body annulus 126 through the upper body threaded section 112. The fluid saver body annulus 126 can further have a fluid saver face 127 that is at about a 60 degree angle, but the fluid saver face 127 can be at an angle from about 40 degrees to about 70 degrees.

The fluid saver body annulus can have an upper chamber 123 and a lower chamber 124 separated by a bullet seal 128 which can be used to seal off the upper and lower chambers. The bullet seal can be a valve, such as a ball valve or a butterfly valve.

A retainer plate 132 can be attached to the bullet seal 128 or valve, as well as being attached to a high compression spring 129 that can be used to mechanically produce force for the seal. A lower retainer plate 150 in the lower chamber can be used to support the high compression spring 129.

The bullet seal 128 or valve can be easily moved from a closed position to an open position by increasing the annulus's fluid pressure.

An increase in fluid pressure in the upper chamber 123 can be accomplished by turning on mud pumps and pumping fluid from a fluid vessel or earth pit containing drilling fluid and pumping the drilling mud downward through the tubular annulus. As fluid pressure is increased in the upper chamber 123, the compression spring can be urged downward. The high compression spring 129 can be compressed within the lower chamber 124 allowing fluid to flow through the lower chamber 124 and into the tubular annulus 160 thus filling and or circulating fluid in the tubular annulus 160.

A retainer groove 134 with a retainer ring 136 can be used to hold the high compression spring in place inside the upper chamber 123.

The fluid saver body 110 can also have a lower body threaded section 138. A nose cone 140 can be threadably inserted into the fluid saver body at the lower body threaded section 138. It is also contemplated that the nose cone can be threadably inserted into the fluid saver body.

The nose cone 140 can be used to guide and align the fluid saver into the annulus of the tubular.

While these embodiments have been described with emphasis on the embodiments, it should be understood that within the scope of the appended claims, the embodiments might be practiced other than as specifically described herein.

What is claimed is:

1. A system for dispensing and circulating fluid in a well bore and controlling a hydraulically operated downhole tool in the wellbore with a fluid saver comprising:

a. a threaded packer sub comprising:

(i) a sub body with a sub body annulus;

(ii) a lower end integral with the sub body, wherein the lower end comprises lower end annulus, wherein the lower end has an lower end exterior on which is disposed a lower end locking groove, a first inner seal, a threaded section, a second inner seal, and wherein an inner threaded shoulder is disposed on the lower end;

(iii) a sub body upper end integral with the sub body opposite the lower end, wherein the sub body upper end comprises:

a. an upper end axis along which is formed an upper end annulus;

b. an upper end sub shoulder in communication with a centering guide face opposite the lower end;

c. an upper end exterior on which is formed an upper locking groove, an upper first inner seal area, an upper threaded section, and an upper locking retainer bore disposed through the upper end at an angle between 60 degrees to 90 degrees from the upper end axis, wherein the upper locking retainer bore is adapted for receiving an upper locking pin; and d. an upper shoulder disposed on the upper end exterior;

b. a quick coupler body for threadably engaging the sub body, wherein the quick coupler body comprises:

(i) a quick coupler annulus disposed along a quick coupler axis;

(ii) a quick coupler exterior;

(iii) a lower threaded adapter formed around the quick coupler annulus having at least a first and second lower threaded retainer bore and a wellbore assembly extension hose connected to the lower threaded adapter;

(iv) a first quick coupler face formed adjacent the lower threaded adapter around the quick coupler annulus;

(v) a quick coupler lower seal disposed around the quick coupler annulus;

(vi) a second seal area formed around the quick coupler annulus;

(vii) an upper threaded area formed around the quick coupler annulus;

(viii) a third seal area formed around the quick coupler annulus;

(ix) a quick coupler locking groove formed in the quick coupler exterior;

(x) a quick coupler retainer bore disposed 60 degrees to 90 degrees from the quick coupler axis adapted for receiving a quick coupler retainer pin;

(xi) a quick coupler guide face formed in the quick coupler exterior; and (xii) a quick coupler shoulder formed in the quick coupler exterior; and c. a fluid saver connected to the wellbore assembly extension hose, wherein diameters for each annulus of the quick coupler body and the sub body are substantially identical enhancing laminar flow through the threaded packer sub.

2. The system of claim 1, wherein the quick coupler body has a quick coupler tapered outer body guide face formed on the quick coupler exterior between the quick coupler lower seal and a quick coupler lower face.

3. The system claim 1, wherein the inner threaded shoulder creates a metal to metal seal with the quick coupler body.

4. The system of claim 1, wherein the lower end and upper end locking grooves support thermoplastic seals.

5. The system of claim 1, wherein the first and second inner seals are o-rings.

6. The system of claim 1, wherein the quick coupler body is carbon steel.

7. The system of claim 1, wherein a gauge ring is disposed over the sub body adjacent the quick coupler shoulder.

8. The system of claim 7, wherein a packer cup surrounds the sub body in proximity to the gauge ring.

9. The system of claim 8, wherein a packer thimble surrounds the sub body adjacent the packer cup.

10. The system of claim 1, wherein the fluid saver comprises a fluid saver body with a fluid saver upper body threaded section, an upper chamber, a lower body threaded section, a lower chamber, and a fluid saver body annulus, wherein a nose cone is attached to the lower body threaded section, and wherein a lower retainer plate in the lower chamber supports a high compression spring for applying pressure against a bullet seal or valve allowing the bullet seal or valve to move between open and closed positions.

11. The system of claim 10, wherein the fluid saver is a mudsaver.

12. A method for circulating and controlling fluids in a wellbore, comprising the steps of:

a. fluidly connecting a fluid saver to a quick coupler sub;

b. threadably engaging a packer sub body with a packer cup to the quick coupler sub forming a circulator sub assembly with fluid saver;

c. using locking grooves to support seals along the circulator sub assembly with fluid saver creating secondary seals for more secure sealing by:

(i) using an upper locking groove of the packer sub body to receive an o-ring or other sealing device;

(ii) using an upper locking retainer bore in the upper locking groove of the packer sub body to receive an upper locking pin;

(iii) securing a seal in a quick coupler locking groove of the quick coupler sub; and (iv) using a quick coupler retainer bore in the quick coupler locking groove of the quick coupler sub to retain a quick coupler retaining pin;

d. lowering the circulator sub assembly with fluid saver into an oil field tubular in a wellbore;

e. allowing the oil field tubular to fill with fluid from a drilling fluid vessel;

f. simultaneously aligning the packer cup with an annulus of the oil field tubular while aligning the quick coupler sub with the annulus of the oil field tubular;

g. filling the annulus of the oil field tubular below the packer cup with the fluid from the drilling fluid vessel allowing fluid circulation to begin in the annulus of the oil field tubular;

h. increasing fluid pressure in an upper chamber of the fluid saver by pumping the fluid from the drilling fluid vessel therein to compress a high compression spring of a compressed spring assembly within a lower chamber of the fluid saver allowing a bullet seal or valve assembly of the fluid saver to move to an open position, thereby allowing the fluid to flow into the lower chamber; and i. allowing the compressed spring assembly to overcome circulating fluid pressures when fluid circulation is discontinued, and allowing the bullet seal or valve assembly of the fluid saver to return from the open position to a closed position in the fluid saver preventing fluid loss and environmental contamination.

13. The method of claim 12, further comprising holding the high compression spring in place using a retainer groove with a retainer ring in the fluid saver.

14. The method of claim 12, further comprising disposing a gauge ring over the packer sub body adjacent a quick coupler shoulder of the quick coupler sub, wherein the packer cup surrounds the packer sub body in proximity to the gauge ring, and wherein a packer thimble surrounds the packer sub body adjacent the packer cup.

15. The method of claim 12, wherein the fluid saver is connected to the quick coupler sub via a metal sub.

16. The method of claim 12, further comprising using a nose cone on the fluid saver to guide and align the fluid saver into the annulus of the oil field tubular.

17. The method of claim 12, wherein the quick coupler sub comprises a lower threaded adapter formed around the quick coupler annulus having a first lower threaded retainer bore and a second lower threaded retainer bore, wherein a wellbore assembly extension hose is connected to the lower threaded adapter, and wherein the method further comprises engaging a locking screw within each of the first lower threaded retainer bore and the second lower threaded retainer bore.

18. The method of claim 17, wherein the quick coupler sub further comprises:

a. a quick coupler annulus disposed along a quick coupler axis;

b. a quick coupler exterior;

c. a first quick coupler face formed adjacent the lower threaded adapter around the quick coupler annulus;

d. a quick coupler lower seal disposed around the quick coupler annulus;

e. a second seal area formed around the quick coupler annulus;

f. an upper threaded area formed around the quick coupler annulus;

g. a third seal area formed around the quick coupler annulus;

h. a quick coupler locking groove formed in the quick coupler exterior;

i. a quick coupler guide face formed in the quick coupler exterior; and j. a quick coupler shoulder formed in the quick coupler exterior.

19. The method of claim 18, wherein the packer sub body comprises:

a. a sub body annulus;

b. a lower end integral with the packer sub body, wherein the lower end comprises a lower end annulus, a lower end exterior, a lower end locking groove disposed on the lower end exterior, a first inner seal, a threaded section, a second inner seal, and an inner threaded shoulder disposed on the lower end; and c. a sub body upper end integral with the packer sub body opposite the lower end, wherein the sub body upper end comprises:

(i) an upper end axis along which is formed an upper end annulus;

(ii) an upper end sub shoulder in communication with a centering guide face opposite the lower end;

(iii) an upper end exterior on which is formed the upper locking groove, an upper first inner seal area, an upper threaded section, wherein the upper locking retainer bore is disposed through the sub body upper end at an angle between 60 degrees to 90 degrees from the upper end axis, and wherein the upper locking retainer bore is adapted for receiving the upper locking pin; and (iv) an upper shoulder disposed on the upper end exterior.

20. The method of claim 17, wherein the first lower threaded retainer bore and the second lower threaded retainer bore are disposed below the lower threaded adapter.

* * * * *